US009455063B2

(12) United States Patent
Krass et al.

(10) Patent No.: US 9,455,063 B2
(45) Date of Patent: Sep. 27, 2016

(54) CABLE STRUCTURES WITH LOCALIZED FOAM STRAIN RELIEFS AND SYSTEMS AND METHODS FOR MAKING THE SAME

(71) Applicant: Apple Inc., Cupertino, CA (US)

(72) Inventors: Derek C. Krass, San Francisco, CA (US); Joseph I. Briskey, Aptos, CA (US)

(73) Assignee: APPLE INC., Cupertino, CA (US)

( * ) Notice: Subject to any disclaimer, the term of this patent is extended or adjusted under 35 U.S.C. 154(b) by 232 days.

(21) Appl. No.: 14/038,215

(22) Filed: Sep. 26, 2013

(65) Prior Publication Data

US 2015/0083490 A1 Mar. 26, 2015

(51) Int. Cl.

| | |
|---|---|
| ***H01B 7/00*** | (2006.01) |
| ***H01B 3/00*** | (2006.01) |
| ***H04R 1/10*** | (2006.01) |

(52) U.S. Cl.

CPC ..... *H01B 3/004* (2013.01); *H04R 1/1033* (2013.01); *H04R 1/1016* (2013.01)

(58) Field of Classification Search

CPC .. H02G 15/00; H02G 15/003; H02G 15/007; H02G 15/013; H02G 15/04; H02G 15/18; H02G 15/1813; H02G 15/24; B60R 16/0207; H01R 13/06; H01B 3/004; H04R 1/1033; H04R 1/1016

USPC . 174/72 A, 76, 92, 84 C, 84 R, 74 R, 110 R, 174/113 R, 116, 110 F, 135, 99 R; 385/114, 385/100; 29/592, 592.1

See application file for complete search history.

(56) References Cited

U.S. PATENT DOCUMENTS

| | | | | |
|---|---|---|---|---|
| 3,836,702 | A * | 9/1974 | Plummer | H02G 15/003 174/76 |
| 4,093,414 | A | 6/1978 | Swiatovy, Jr. | |
| 4,954,670 | A * | 9/1990 | Jensen | H02G 15/1813 174/92 |
| 5,397,859 | A * | 3/1995 | Robertson | H02G 15/18 174/84 R |
| 5,611,017 | A * | 3/1997 | Lee | G02B 6/4403 385/114 |
| 5,725,814 | A | 3/1998 | Harris | |
| 5,817,979 | A * | 10/1998 | O'Neill | H02G 15/007 174/84 C |
| 6,126,228 | A * | 10/2000 | Davis, Jr. | B60R 16/0207 174/72 A |
| 6,648,024 | B2 | 11/2003 | Wang | |
| 6,663,614 | B1 | 12/2003 | Carter | |
| 7,256,350 | B2 * | 8/2007 | Stagi | H02G 15/24 174/92 |
| 7,273,487 | B1 | 9/2007 | Duchamp et al. | |
| 7,555,181 | B2 | 6/2009 | Temple, Jr. et al. | |
| 7,572,979 | B2 * | 8/2009 | Otsuki | H02G 15/18 174/84 R |
| 7,813,605 | B2 | 10/2010 | Mumm | |
| 8,457,461 | B2 | 6/2013 | Ott | |
| 2002/0017392 | A1 | 2/2002 | Efraimsson et al. | |
| 2010/0104126 | A1 | 4/2010 | Greene | |
| 2011/0132633 | A1 | 6/2011 | Montena | |
| 2011/0180321 | A1 | 7/2011 | Aase et al. | |
| 2012/0228793 | A1 | 9/2012 | Lindenfelzer et al. | |
| 2012/0231192 | A1 | 9/2012 | Lindenfelzer et al. | |
| 2012/0232175 | A1 | 9/2012 | Lindenfelzer et al. | |
| 2013/0084382 | A1 | 4/2013 | Ardisana, II | |
| 2013/0087361 | A1 | 4/2013 | Kaga et al. | |
| 2013/0122293 | A1 | 5/2013 | Weber et al. | |

* cited by examiner

*Primary Examiner* — Angel R Estrada
(74) *Attorney, Agent, or Firm* — Van Court & Aldridge LLP

(57) ABSTRACT

Cable structures with localized foam strain reliefs and systems and methods for making the same are provided. In some embodiments, at least one localized foam strain relief may be incorporated into or positioned underneath a cover of a cable structure. For example, the ratio of base material to foam material may be varied during the manufacture of the cover, such that distinct portions of the cover may include more foam than other portions of the cover. This may provide localized strain relief properties to the cable structure while also obviating the need for additional strain relief components to be provided adjacent to or over specific portions of the cover.

27 Claims, 6 Drawing Sheets

300

400

500

CABLE STRUCTURES WITH LOCALIZED FOAM STRAIN RELIEFS AND SYSTEMS AND METHODS FOR MAKING THE SAME

FIELD OF THE INVENTION

This can relate to cable structures and, more particularly, to cable structures with localized foam strain reliefs and systems and methods for making the same.

BACKGROUND OF THE DISCLOSURE

A conventional cable structure used for data and/or power signal transmission typically includes at least one conductor extending along a length of the cable structure and a cover surrounding the conductor along at least a portion of the length of the cable structure. Often times, a strain relief component is positioned over a portion of the cover or adjacent to an end of the cover to dampen strains on the cable structure. However, such a strain relief component is often too large and/or too visually distinct from the remainder of the cable structure for desired cosmetic properties of the cable structure. Accordingly, alternative strain reliefs for cable structures are needed.

SUMMARY OF THE DISCLOSURE

Cable structures with localized foam strain reliefs and systems and methods for making the same are provided. Each localized foam strain relief may be incorporated into or positioned underneath a cover of the cable structure, which may provide a seamless look and feel to the cable structure.

For example, in some embodiments, there is provided a method for forming a cable structure that may include disposing an extrudable material in a processing space of a system, where the extrudable material may include a base material and a foam material. The method may also include extruding the extrudable material through a die of the system and, during the extruding, changing a relationship between the base material and the foam material in the extrudable material.

In other embodiments, there is provided a cable structure that may include a conductor arrangement extending along a length of the cable structure and a cover surrounding the conductor arrangement along the length of the cable structure, where the density of the cover may vary along the length of the cable structure.

In yet other embodiments, there is provided a cable structure that may include a conductor arrangement extending along a longitudinal axis of a length of the cable structure and a cover disposed about the conductor arrangement along the longitudinal axis. At a first cross-section of the cable structure that is perpendicular to the longitudinal axis, the cover may include a first amount of foam. At a second cross-section of the cable structure that is perpendicular to the longitudinal axis, the cover may include a second amount of foam that is less than the first amount of foam.

BRIEF DESCRIPTION OF THE DRAWINGS

The above and other aspects of the invention, its nature, and various features will become more apparent upon consideration of the following detailed description, taken in conjunction with the accompanying drawings, in which like reference characters may refer to like parts throughout, and in which.

DETAILED DESCRIPTION OF THE DISCLOSURE

Cable structures with localized foam strain reliefs and systems and methods for making the same are provided and described with reference to FIGS. 1-5.

A cable structure can include at least one localized foam strain relief incorporated into or positioned underneath a cover of the cable structure. Such a localized foam strain relief may be provided along any suitable portion of the length of the cover and may be any suitable size and shape that may differ from but that may seamlessly integrate with an adjacent portion of the cover. For example, the ratio of base material to foam material may be varied during the manufacture of a cable structure cover, such that distinct portions of the cover may include more foam than other portions of the cover. This may provide localized strain relief properties to the cable structure while also obviating the need for additional strain relief components to be provided adjacent to or over specific portions of the cover. Varying the amount of foam material used to form a cable structure cover during a single manufacture process may enable the cover to have a seamless look and feel while also reducing the number of manufacture processes required to create the cable structure.

Figure 1:
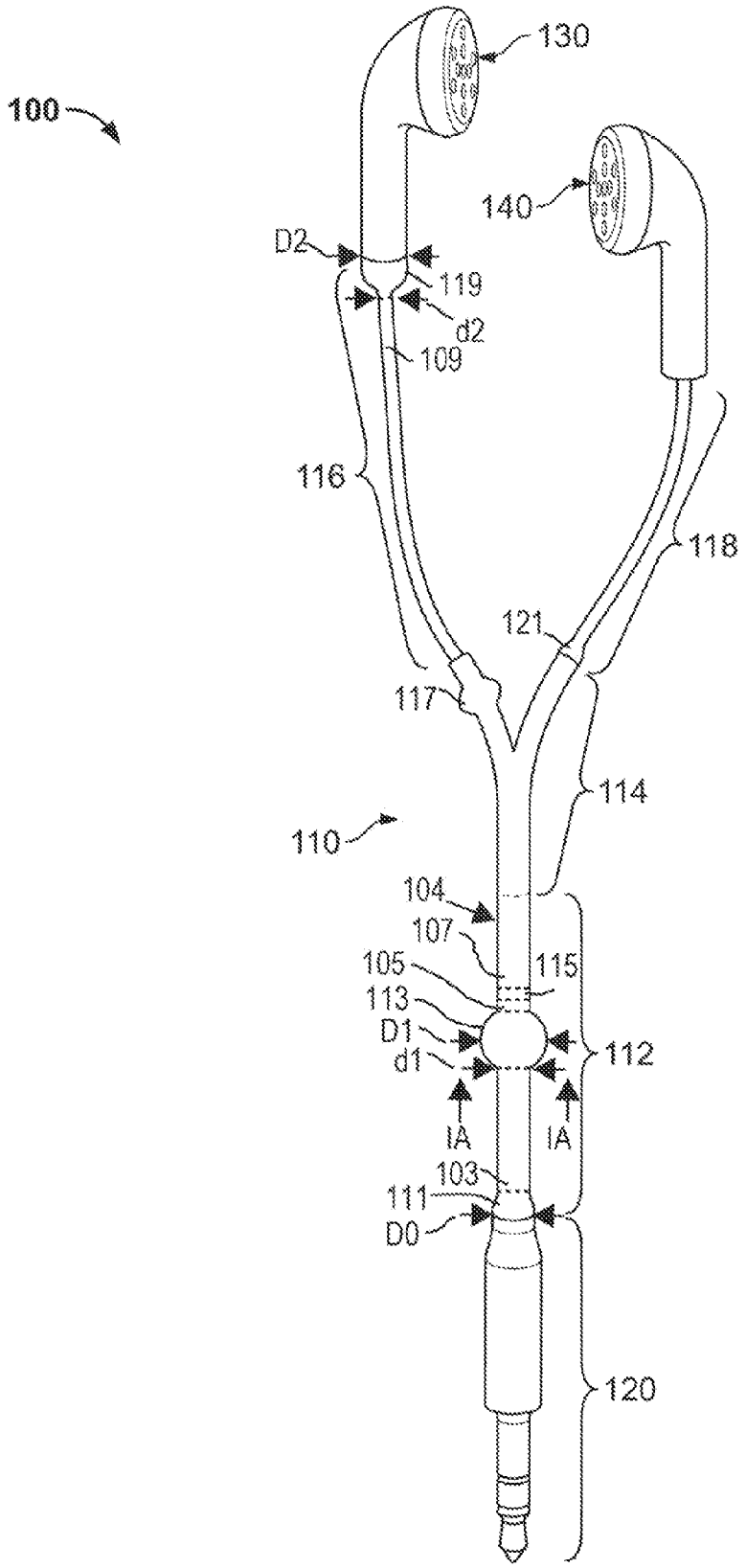
FIG. 1 is a perspective view of an illustrative assembly that includes at least one cable structure with a localized foam strain relief, in accordance with some embodiments of the invention.

A cable structure including at least one localized foam strain relief may be provided as part of any suitable cabled assembly. For example, as shown in FIG. 1, a cabled headset assembly 100 may include a cable 110 that can electrically couple two or more non-cable components of assembly 100 (e.g., cable 110 may electrically couple an audio connector 120 to a left speaker 130 and/or a right speaker 140 of assembly 100). Cable 110 may include a main cable structure 112 that may extend between audio connector 120 and a bifurcation cable structure (e.g., forked structure) 114 of cable 110. Cable 110 may also include a left cable structure 116 that may extend between bifurcation cable structure 114 and left speaker 130. Alternatively or additionally, cable 110 may include a right cable structure 118 that may extend between bifurcation cable structure 114 and right speaker 140.

Figure 1A:
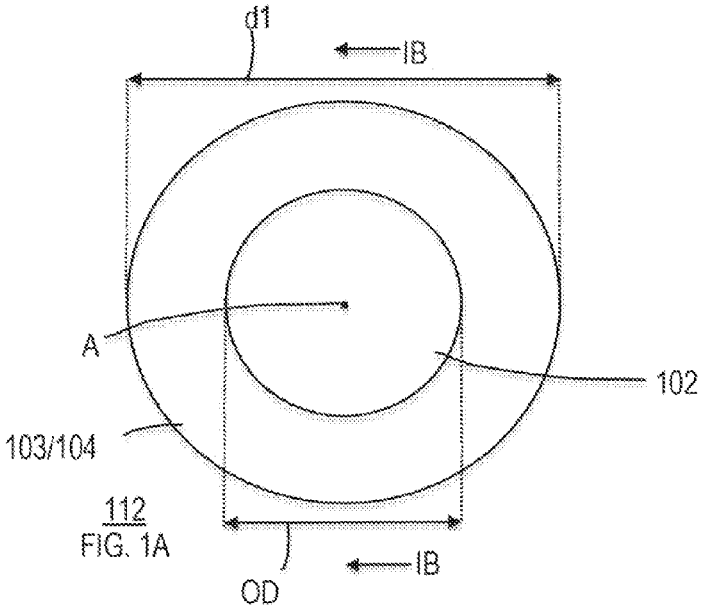
FIG. 1A is a cross-sectional view of a portion of a cable structure of FIG. 1, taken from line IA-IA of FIG. 1, in accordance with some embodiments of the invention.
Figure 1B:
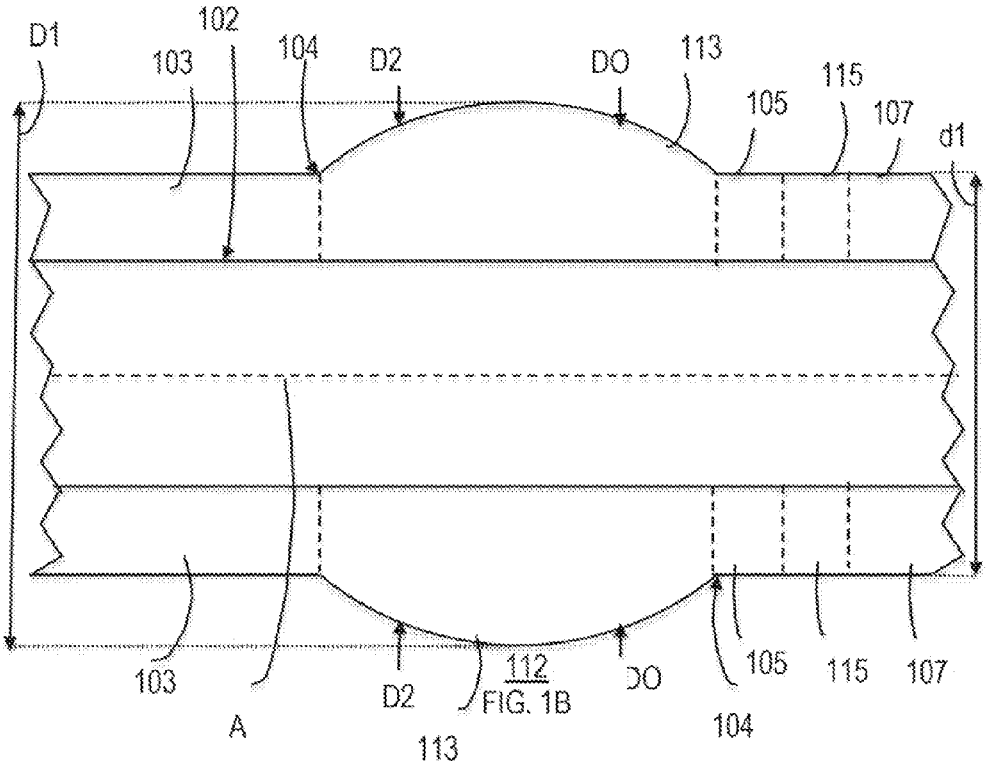
FIG. 1B is a cross-sectional view of the cable structure of FIGS. 1 and 1A, taken from line IB-IB of FIG. 1A, in accordance with some embodiments of the invention.

A conductor arrangement including one or more conductors may extend through each one of cable structures 112, 114, 116, and 118, and may be configured to transmit data and/or power signals between audio connector 120, left speaker 130, and right speaker 140. Moreover, each one of cable structures 112, 114, 116, and 118 may include a cover that may surround its conductor arrangement along at least a portion of the length of the cable structure. For example, as shown in FIGS. 1A and 1B, main cable structure 112 may include a conductor arrangement 102 extending along a length of main cable structure 112 (e.g., along a longitudinal axis A of main cable structure 112) and a cover 104 that may surround conductor arrangement 102 along at least a portion of the length of main cable structure 112 (e.g., along longitudinal axis A). Such a cover may provide protection for its conductor arrangement (e.g., insulation or shielding) and may, in some embodiments, provide an outer surface of its cable structure. In other embodiments, an additional element may be positioned about the outer surface of the cover for providing the outermost surface of a cable structure.

Any one or more of cable structures 112, 114, 116, and 118 may include at least one localized foam region, which may provide strain relief to dampen strains on cable 110. In some embodiments, such a foam region may be incorporated into a cover of the cable structure. In other embodiments, such a foam region may be incorporated in between a cover of the cable structure and a conductor arrangement of the cable structure. Such a foam region may include one or more cells or voids (e.g., pockets of gas) formed within a base material of the cover, whereby the foam region may use less base material for a given volume than a non-foam region of the cover. Thus, in some embodiments, a foam region may reduce the density, weight, and/or cost of material for that region of the cover, while also increasing the elongation, tensility, and/or any other suitable strain relief capability for that region of the cover, thereby better enabling the cable structure to withstand bend stresses.

For example, as shown in FIG. 1, main cable structure 112 may include a first foam region 111 at an end portion of cover 104 of main cable structure 112 that is adjacent to audio connector 120. Additionally or alternatively, as shown in FIGS. 1-1B, cover 104 of main cable structure 112 may include a second foam region 113 along a middle portion of the length of main cable structure 112 between a first non-foam region 103 and a second non-foam region 105 of main cable structure 112, and a third foam region 115 along a middle portion of the length of main cable structure 112 between second non-foam region 105 and a third non-foam region 107 of main cable structure 112. Moreover, as also shown in FIG. 1, bifurcation cable structure 114 may include a foam region 117 along a middle portion of the length of bifurcation cable structure 114 between main cable structure 112 and left cable structure 116, while left cable structure 116 may include a foam region 119 at an end portion of left cable structure 116 that is adjacent to left speaker 130, and while right cable structure 118 may include a foam region 121 at an end of right cable structure 118 that is adjacent to bifurcation cable structure 114.

In some embodiments, it may be desirable for at least a portion of each cable structure of a cable (e.g., cable structures 112, 114, 116, and 118 of cable 110) to have as small a diameter or cross-section as possible (e.g., for aesthetic reasons). As a result, the diameter or cross-sectional size of a non-foam region (e.g., a non-strain relief region) of a cable structure may be smaller than the diameter or cross-sectional size of one or more foam regions of the cable structure. For example, as shown in FIGS. 1-1B, a diameter d1 of non-foam region 103 of cover 104 of main cable structure 112 may be smaller than a diameter D1 of adjacent foam region 113 of cover 104 of main cable structure 112. In some embodiments, it may be desirable for each cable structure of a cable to seamlessly integrate with an adjacent cable structure or with an adjacent non-cable component (e.g., for aesthetic reasons). As a result, the diameter or cross-sectional size of a foam region of a cable structure may vary from the diameter of an adjacent non-foam region of the cable structure to the diameter of an adjacent cable structure or to the diameter of an adjacent non-cable component. For example, as shown in FIG. 1, a diameter of foam region 111 of cover 104 of main cable structure 112 may change or otherwise transition from a diameter D0, which may be equal to the diameter of an adjacent portion of audio connector 120, to diameter d1, which may be equal to the diameter of adjacent non-foam region 103 of cover 104 of main cable structure 112. As another example, as also shown in FIG. 1, a diameter of foam region 119 of left cable structure 116 may change or otherwise transition from a first diameter d2, which may be equal to the diameter of an adjacent non-foam region 109 of left cable structure 116, to a second diameter D2, which may be equal to the diameter of an adjacent portion of left speaker 130. Such a diameter changing transition of a foam region of a cable structure may take any suitable shape, such as any suitable shape that may exhibit a fluid or smooth transition. For example, the shape of the transition of a foam region can be similar to that of a cone or a neck of a wine bottle. As another example, the shape of the transition of a foam region can be stepless (i.e., there may be no abrupt or dramatic step change in diameter, or no sharp angle at an end of the transition). In some embodiments, the diameter changing transition of a foam region may be mathematically represented by a bump function, which may require the entire diameter changing transition to be stepless and smooth (e.g., the bump function may be continuously differentiable).

As a foam region may increase the diameter or cross-sectional size of a portion of a cable structure, strain relief may be realized for that cable structure due to the extra girth provided by the foam region. Moreover, such a larger dimension of a foam region compared to another portion of a cable structure (e.g., an adjacent non-foam region) may enable a more secure connection (e.g., via an adhesive or any other suitable connection mechanism) between that cable structure and an adjacent component (e.g., an adjacent cable structure or an adjacent non-cable component). For example, as shown in FIG. 1, the connection between left speaker 130 and the larger diameter D2 of foam region 119 of left cable structure 116 may be more robust and more secure than if foam region 119 did not exist and instead left speaker 130 were connected to left cable structure 116 at smaller diameter d2 of non-foam region 109. Alternatively, the diameter or cross-sectional size of a non-foam region (e.g., a non-strain relief region) of a cable structure may be smaller than or the same size as the diameter or cross-sectional size of one or more foam regions of the cable structure. For example, as also shown in FIGS. 1-1B, diameter d1 may be shared by non-foam region 105, foam region 115, and non-foam region 107 of cover 104 of main cable structure 112. As mentioned, a foam region of a cover of a cable structure may have a lower density than a non-foam region of the cover (e.g., whether the diameter of the foam region is larger than, smaller than, or equal to the diameter of the non-foam region), which may increase the elongation, tensility, and/or any other suitable strain relief capability of the foam region, thereby better enabling the cable structure to withstand bend stresses.

A cable structure including at least one localized foam strain relief (e.g., any one of cable structures 112, 114, 116, and 118 of FIG. 1) can be constructed using any suitable manufacturing process or combination of manufacturing processes. For example, in some embodiments, a cable structure including at least one localized foam strain relief can be at least partially constructed via an extrusion process, and such an extrusion process may include one or more controllable system factors for adjusting one or more characteristics of a localized foam strain relief.

Figure 2:
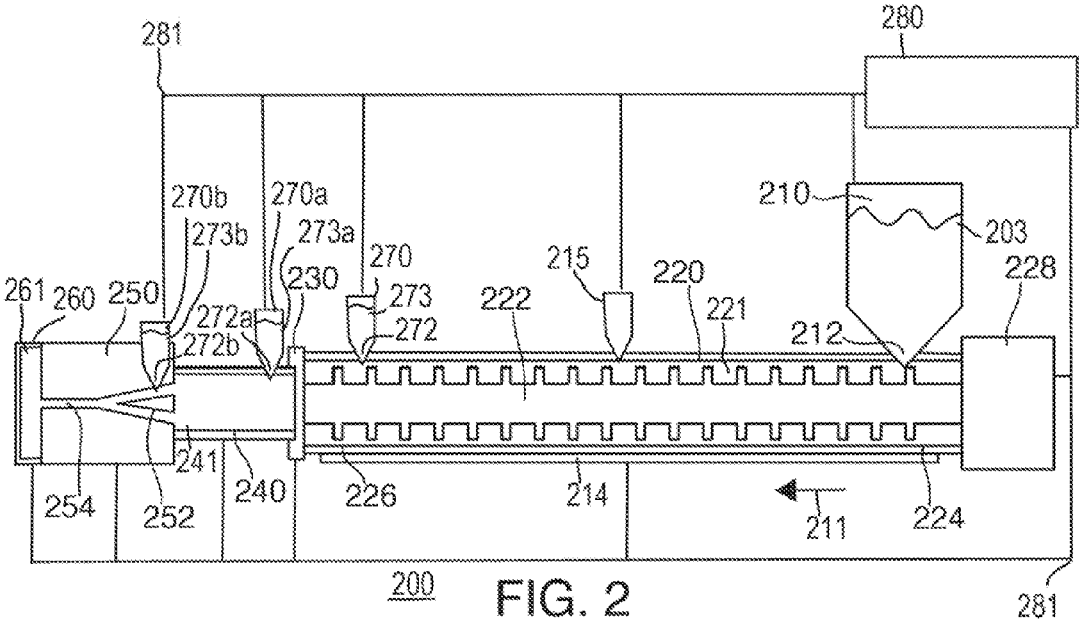
FIG. 2 is a cross-sectional view of an illustrative system that may be used to manufacture at least a portion of the cable structure of FIGS. 1-1B, in accordance with some embodiments of the invention.

FIG. 2 is a cross-sectional view of an illustrative extruder system 200. Extruder system 200 can receive any suitable base material or combination of base materials to be extruded in a first form, such as pellets, and can transform the base material or combination of base materials to a form corresponding to at least a portion of a cover of one or more of cable structures 112, 114, 116, and 118 of FIG. 1 (e.g., cover 104 of FIGS. 1-1B). For example, extruder system 200 can use any suitable base material 203, which may include, but is not limited to, polyethylene, polypropylene, acetal, acrylic, polyamide (e.g., nylon), polystyrene, acrylonitrile butadiene styrene ("ABS"), any thermoplastic elastomer ("TPE"), fluoropolymer, polycarbonate, and any suitable combination thereof. Such base material 203 may be provided to extruder system 200 via a hopper 210 for processing in any suitable form including, for example, in liquid or solid form (e.g., pellets or chips of base material 203 can be provided within hopper 210). A feedthroat 212 of hopper 210 may control the passing of base material 203 from hopper 210 into a cavity 221 of barrel 220 for processing. A screw 222 or any other suitable mechanism can be positioned within cavity 221 of barrel 220 and may be configured to rotate or otherwise move within cavity 221 (e.g., at the direction of a drive motor 228) to direct base material 203 from a hopper end 224 of barrel 220 to a die end 226 of barrel 220 (e.g., in the direction of arrow 211). Drive motor 228 can drive screw 222 at any suitable rate, speed, and/or any other suitable movement characteristic, including a variable speed.

Extruder system 200 may be provided with one or more thermal components 214 along one or more portions of barrel 220. Each thermal component 214 may be configured to heat barrel 220 to any desired melt temperature, which may melt at least a portion of base material 203 passing through cavity 221. For example, barrel 220 can be heated to a temperature in the range of 200° Celsius to 300° Celsius (e.g., 250° Celsius), although the particular temperature can be selected based on each base material 203 used. As base material 203 passes through cavity 221 of barrel 220, pressure and friction created by screw 222 and/or heat applied to barrel 220 by thermal component 214 can cause the material to melt and flow. The resulting material can be substantially liquid in a region near die end 226 of barrel 220 so that it may easily flow into a die 250 (e.g., via a screen subassembly 230 and/or via a feedpipe 240). In some embodiments, different amounts of heat can be applied to different sections of barrel 220 to create a variable heat profile. For example, the amount of heat provided to barrel 220 can increase from hopper end 224 to die end 226. By gradually increasing the temperature of barrel 220 from hopper end 224 to die end 226, base material 203 deposited in cavity 221 of barrel 220 can gradually heat up and melt as it is pushed toward die end 226 in the direction of arrow 211. This may reduce the risk of overheating, which may cause base material 203 to degrade. In some embodiments, one or more thermal components 214 of extruder system 200 may be configured to cool barrel 220 for controlling a temperature profile of barrel 220. For example, thermal component 214 may include a heating component (e.g., electrical heaters) and a cooling component (e.g., a fan). Each thermal component 214 may be configured to operate differently at different locations along barrel 220 (e.g., to heat barrel 220 at one or more locations, and to cool barrel 220 at one or more different locations). Any number of thermal components 214 can be provided along barrel 220 and/or along any other portion of system 200 (e.g., along a portion of feedpipe 240 and/or die 250 and/or treatment module 260 (not shown)).

Screw 222 can have any suitable channel depth and/or screw angle for directing material within cavity 221 towards die 250. In some embodiments, screw 222 can define several zones, each of which may be designed to have different effects on the material within cavity 221. For example, screw 222 can include a feed zone adjacent to hopper 210 that may be operative to carry solid material pellets of base material 203 to an adjacent melting zone where the solid material may melt. The channel depth of screw 222 can progressively increase in such a melting zone. Following such a melting zone, a metering zone can be used to melt the last particles of the material and mix the material to a uniform temperature and composition. In some embodiments, screw 222 can also include a decompression zone in which the channel depth may increase to relieve pressure within the screw and allow trapped gases (e.g., moisture or air) to be drawn out of cavity 221 (e.g., by a vacuum 215). In such embodiments, screw 222 may also include a second metering zone having a lower channel depth to re-pressurize the fluid material and direct it further towards die 250 in the direction of arrow 211 (e.g., at a constant and predictable rate).

When fluid material reaches die end 226 of barrel 220, the material can be expelled from barrel 220 and can pass through screen subassembly 230, which may include one or more screens, each of which may include one or more openings that may be sized to allow the material to flow therethrough (e.g., in the direction of arrow 211) but that may also be sized to prevent contaminants from passing therethrough. Screen subassembly 230 can be reinforced by a breaker plate that may be used to resist the pressure of the material as it is pushed towards die 250 by screw 222. In some embodiments, screen subassembly 230, with or without such a breaker plate, may be configured to provide back pressure to barrel 220 so that the material can melt and mix uniformly within cavity 221 of barrel 220. The amount of pressure provided can be adjusted by changing the number of screens of screen subassembly 230, by changing the relative positions of the screens of screen subassembly 230 (e.g., through mis-aligning openings in stacked screens), by changing the size of openings in each screen of screen subassembly 230, and/or by changing any other suitable characteristic of screen subassembly 230.

The material passing through screen subassembly 230 may be directed through feedpipe 240 towards die 250. Feedpipe 240 can define an elongated feedpipe volume 241 through which material can flow. Unlike within cavity 221 of barrel 220, in which material may rotate, material passing through feedpipe volume 241 of feedpipe 240 can travel along the axis of feedpipe 240 (e.g., along the direction of arrow 211) with little or no rotation. This can ensure that when the material reaches die 250, there may be no built-in rotational stresses or strains that may adversely affect the resulting cable structure (e.g., stresses that may cause warping upon cooling).

Fluid material passing through volume 241 of feedpipe 240 can reach die 250, where the material may be given an initial profile, which may or may not correspond to the final profile of the cover of the cable structure. Material can pass from volume 241 of feedpipe 240 into at least one die opening 254 of die 250 and around at least one pin 252 that may be positioned within die opening 254. Each one of pin 252 and opening 254 can have any suitable shape including, for example, a circular shape, curved shape, polygonal shape, or any arbitrary shape. In some embodiments, at least one pin 252 can be movable within opening 254 of die 250, for example, such that the size or shape of at least one die opening 254 can be varied (e.g., during the extrusion process for a particular cable structure). Such movement of elements within die 250 may be controllable for adjusting a characteristic of the material passed out of die opening 254 (i.e., in the direction of arrow 211), such as a cross-sectional geometry.

In some embodiments, a hypodermal path (not shown) may be provided to extend through die pin 252 (e.g., through a centerline of pin 252) or any other suitable element of system 200, such that a conductor arrangement (e.g., conductor arrangement 102) may be fed through the hypodermal path (e.g., in the direction of arrow 211) and into die opening 254. As a conductor arrangement is fed through such a hypodermal path, material flowing from feedpipe volume 241 of feedpipe 240 through die opening 254 may surround the conductor arrangement as it exits the hypodermal path (e.g., the material may form cover 104 that may surround conductor arrangement 102 of main cable structure 112 of FIGS. 1A and 1B). In some alternative embodiments, a rod may instead be fed through such a hypodermal path and material flowing from feedpipe 240 may instead be extruded around such a rod by die 250. Such a rod can have any suitable dimensions including, for example, a constant or variable cross-section, and may be coated or treated so that it may minimally adhere to the extruded material. Such a rod can be removed from the resulting structure formed by the extrusion process to form a hollow tube through which a conductor arrangement can then be fed.

To ensure that an external surface of the cover of the cable structure created using an extrusion process of extruder system 200 may be smooth and/or that the material may be uniformly distributed around a conductor arrangement, the conductor arrangement may be covered or surrounded along its length by a sheath (not shown) that may maintain a constant fixed and/or smooth outer diameter (e.g., diameter OD of conductor arrangement 102 of FIG. 1A). Thus, while the outer diameter of the conductor arrangement may remain constant and/or smooth, the diameter of the extruded cover about the conductor arrangement can vary (e.g., from diameter d1 to diameter D1). Otherwise, in the absence of a smooth outer surface, material of a cover extruded over a conductor arrangement may mirror or mimic discontinuities of the outer surface of the conductor arrangement. For example, if the conductor arrangement includes two distinct conductors placed length-wise side by side (e.g., along axis A), the outer surface of the extruded cover may include at least one indentation or discontinuity that reflects the separation between the conductors of such a conductor arrangement.

In any event, once material has passed through die 250, with or without a rod or conductor arrangement, the resulting structure (e.g., extrudate) may be fed into a treatment volume 261 of at least one treatment module 260, which may be configured to thermally treat, pressure treat, and/or treat in any other suitable way at least a portion of the extruded material provided by die 250. For example, at least a portion of the extruded material provided by die 250 may be cooled within treatment volume 261 using any suitable approach, such as, for example, via a liquid bath (e.g., a water bath), air cooling, vacuum cooling, or combinations of these. As another example, at least a portion of the extruded material provided by die 250 may pressurized or de-pressurized within treatment volume 261 (e.g., using a vacuum treatment module 260). Treatment module 260 may be configured to provide the extruded material with its final profile, which may be the profile of the cover of the cable structure.

In some embodiments, one or more additives can be added to base material 203 within any suitable processing space of system 200 to provide mechanical or finishing attributes to the cover of the cable structure. For example, one or more additives for providing any suitable attribute, such as for providing ultra-violet ("UV") protection, modifying a coefficient of friction of an outer surface of the cover, refining a color of the cable structure, or combinations of these, may be used. The additives can be provided in hopper 210 along with base material 203. Additionally or alternatively, such additives may be inserted into cavity 221 of barrel 220 at another position along the length of barrel 220 between hopper end 224 and die end 226. Additionally or alternatively, such additives may be inserted into feedpipe volume 241 of feedpipe 240, into die opening 254 of die 250, and/or into treatment volume 261 of treatment module 260. The amount of any additives that may be added and the particular position at which any additives may be added can be selected based on any attributes of base material 203. For example, additives can be added when base material 203 reaches a particular fluidity to ensure that the additives can mix with base material 203.

A foam material may be incorporated into an extrusion process of extruder system 200, which may provide one or more foam regions along the length of a cover of a cable structure (e.g., foam region 113 of cover 104 of main cable structure 112 of FIGS. 1-1B). For example, as shown in FIG. 2, extruder system 200 may use any suitable foaming agent or foam material 273, including, but not limited to, any suitable blowing agent (e.g., carbon dioxide, nitrogen, one or more hydrocarbons, one or more chlorofluorocarbons, any suitable combination thereof, and the like), which may be a physical blowing agent and/or a chemical blowing agent. For example, a chemical reaction of materials may create a gas and, thus, voids, and/or gas may be physically injected into the material. In some embodiments, foam material 273 may also include one or more suitable base materials (e.g., any suitable base material described above with respect to base material 203), and/or foam material 273 may be a foaming agent that may be selectively combined with base material 203 from hopper 210 at one or more locations within extruder system 200 during an extruding process.

Foam material 273 may be provided to extruder system 200 via a foam source 270 for processing in any suitable form including, for example, a liquid, solid, and/or gas form. A metering device 272 of foam source 270 may control the passing of foam material 273 from foam source 270 into any suitable processing space of system 200 (e.g., barrel cavity 221, feedpipe volume 241, die opening 254, and/or treatment volume 261) for further processing by system 200 to at least partially form a foam region along the length of a cover of a cable structure (e.g., foam region 113 of cover 104 of main cable structure 112 of FIGS. 1-1B). For example, in some embodiments, metering device 272 of foam source 270 may control the passing of foam material 273 from foam source 270 into cavity 221 of barrel 220. In such embodiments, screw 222 and thermal component 214 may be appropriately controlled to enable any base material 203 that may be within cavity 221 (e.g., as introduced by feedthroat 212 of hopper 210) to be mixed or otherwise combined with any foam material 273 that may also be within cavity 221 (e.g., as introduced by metering device 272 of foam source 270) along a particular portion of system 200. Foam material 273 may be introduced into cavity 221 at any suitable portion of barrel 220 between ends 224 and 226. For example, as shown in FIG. 2, metering device 272 may introduce foam material 273 into cavity 221 proximate die end 226 (e.g., downstream in the direction of arrow 211 from where base material 203 may be introduced into cavity 221 by hopper 210). In other embodiments, foam material 273 and base material 203 may be configured to be introduced at the same general portion of cavity 221.

Alternatively or additionally, as shown in FIG. 2, a metering device 272*a* of a foam source 270*a* may control the passing of a foam material 273*a* from foam source 270*a* into feedpipe volume 241 of feedpipe 240 for further processing by system 200 to at least partially form a foam region along the length of a cover of a cable structure (e.g., foam region 113 of cover 104 of main cable structure 112 of FIGS. 1-1B). Alternatively or additionally, as also shown in FIG. 2, a metering device 272*b* of a foam source 270*b* may control the passing of a foam material 273*b* from foam source 270*b* into die opening 254 of die 250 for further processing by system 200 to at least partially form a foam region along the length of a cover of a cable structure (e.g., foam region 113 of cover 104 of main cable structure 112 of FIGS. 1-1B). Alternatively or additionally, although not shown in FIG. 2, a metering device may control the passing of a foam material from a foam source into treatment volume 261 of treatment module 260 for further processing by system 200 to at least partially form a foam region along the length of a cover of a cable structure (e.g., foam region 113 of cover 104 of main cable structure 112 of FIGS. 1-1B). It is to be understood that, in some embodiments, at least two different sources of material (e.g., base material and/or foam material) may each be fed into a single crosshead of a system, whereby the extrusion of material from each source may be alternated or variably controlled through the crosshead. At least one melt pump may be associated with each source of material for variably controlling or alternating how the crosshead may be fed with material from each source. In some embodiments, a crosshead may form an angle (e.g., 90°) between an axis along which a conductor bundle travels towards a die and an axis along which material is introduced for being extruded about the conductor bundle.

Different foam materials may be introduced into the same or different processing spaces of system 200 (e.g., barrel cavity 221, feedpipe volume 241, die opening 254, and/or treatment volume 261) for mixing together to help form a foam region of a cover of a cable structure. For example, in some embodiments, different foam materials may be mixed in a single foam source 270 or prior to deposition within a single foam source 270, such that the different foam materials may be mixed before being introduced into a processing space of system 200. Alternatively or additionally, different foam materials may be mixed within a processing space of system 200 after being introduced into the same processing space via different foam metering devices or after being introduced into different processing spaces via different foam metering devices. Each foam metering device (e.g., each one of metering devices 272-272*b*) may be configured to control the amount of a foam material or the amount of a combination of foam materials that may be introduced into a processing space of system 200, which may enable a particular amount of foam material to be maintained at a particular level or to be varied according to desired characteristics of the cable structure being formed. In some embodiments, a foam metering device may meter a mass flow rate of a foam material.

A single-phase solution of a foam material (e.g., foam material 273) and base material 203 may be formed in a processing space of system 200, and such a single-phase solution may be nucleated upon being extruded through die 250. For example, the solution may experience a pressure drop when being extruded through die 250, which may induce nucleation. Alternatively, a mixture of a foam material and base material 203 may not be a single-phase solution. In some embodiments, a foam material (e.g., one or more of foam materials 273-273*b*) may impregnate a base material (e.g., base material 203) with compressed nitrogen bubbles or any other suitable foaming agent, and such a mixture may then be treated in treatment module 260 to explode the compressed nitrogen bubbles. For example, a portion or the entirety of an extruded structure that may contain such compressed nitrogen bubbles therein may be positioned within a vacuum chamber treatment module 260 with a negative pressure (e.g., at $-10^6$ Torr), which may explode at least some of the compressed nitrogen bubbles within the portion of the structure positioned within treatment module 260. Therefore, selective portions of such impregnated compressed nitrogen bubbles may be exploded for generating one or more foam regions of the extruded structure while other portions of such impregnated compressed nitrogen bubbles (e.g., those portions not treated within treatment module 260) may not be exploded and may be provided as part of one or more non-foam regions of the extruded structure.

Various system factors relating to the extrusion process of extruder system 200 can be adjusted to change one or more characteristics of the created structure (e.g., for generating a localized foam strain relief region and/or altering one or more of its characteristics). As mentioned, movement of pin 252 within die opening 254 of die 250 during an extrusion process may alter the size and/or shape of the created cable structure. As another example, the speed at which a rod or conductor arrangement may be passed through die 250 can be adjusted to change the diameter of the resulting structure extruded thereabout (e.g., the faster the line speed of the rod or conductor arrangement, the smaller the diameter of the resulting cover of the cable structure thereabout). As another example, the speed at which screw 222 may bring material to die 250 can be adjusted to control the amount of material passing through die 250 in a particular period of time (e.g., the rotational speed of screw 222 may be adjusted via motor 228). As yet another example, the amount of heat provided to barrel 220 (e.g., via thermal component 214) may control the viscosity of the material within cavity 221 of barrel 220 and/or the pressure within cavity 221 of barrel 220. As still another example, the melt pressure of the material within cavity 221 of barrel 220 can be adjusted. As still yet another example, characteristics of treatment module 260 may be adjusted to control one or more reactions within the extruded structure (e.g., to explode impregnated compressed nitrogen bubbles along particular portions of an extruded cable structure). As still yet another example, one or more screens and/or breaker plates of screen subassembly 230 can be adjusted to control the amount of material passing from barrel 220 to die 250. As more material passes through die 250 in a particular amount of time, the diameter of a resulting structure may be increased. As still yet another example, one or more material characteristics of the particular base material 203 provided within the cable structure, one or more material characteristics of the particular foam material 273 provided within the cable structure, one or more relative ratios of one or more material characteristics between the particular base material 203 provided within the cable structure and the particular foam material 273 provided within the cable structure, and the like may be adjusted to control the material composition of the cable structure along various portions of its length. Specific settings for any one or more of these exemplary system factors of extruder system 200 can be dynamically adjusted during the extrusion process to change one or more characteristics of the created structure (e.g., for generating a localized foam strain relief region and/or altering one or more of its characteristics). Any one or more of these system factors can be adjusted by any suitable component of extruder system 200, such as, for example, by a control station 280 of system 200 that may be electrically coupled to and control one or more of the other components of system 200 (e.g., one or more of hopper 210, vacuum 215, thermal component 214, motor 228, screen subassembly 230, feedpipe 240, die 250, treatment module 260, foam source 270, foam source 270*a*, foam source 270*b*, and the like) via one or more data and/or power buses 281.

In particular, by dynamically adjusting system factors, extruder system 200 can create a cable structure that may include at least one localized foam strain relief region along a portion of a length of a cover of a cable structure (e.g., foam region 113 along a portion of cover 104 of main cable structure 112 of FIGS. 1-1B), where a transition change between the strain relief region and a non-strain relief region of the cover of the cable structure may be smooth and/or seamless. For example, the transition between a non-foam region and a foam region of a cover (e.g., from non-foam region 105 to foam region 115 of cover 104 of FIGS. 1 and 1B) may be visually unidentifiable to a user. In some embodiments, one or both of the amount of a characteristic of foam material 273 and the amount of a characteristic of base material 203 provided in a certain portion of a cable structure cover may be varied over the length of the cover (e.g., may be varied amongst adjacent cross-sections of the cover along axis A, such as the cross-section of FIG. 1A that may be perpendicular to the extrusion process direction for the structure (e.g., the direction of arrow 211 of FIG. 2)), thereby changing a relationship between base material 203 and foam material 273 along the length of the cover. For example, the amount of a characteristic (e.g., mass) of base material 203 extruded through die opening 254 of die 250 at any moment in time may be constant throughout the length of the cover, while the amount of that characteristic of foam material 273 extruded through die opening 254 of die 250 at any moment in time may be varied according to any suitable shape wave (e.g., a sine wave or any other suitable wave that may mimic the desired outer diameter shape or material characteristic profile of the created cover structure).

Figure 3:
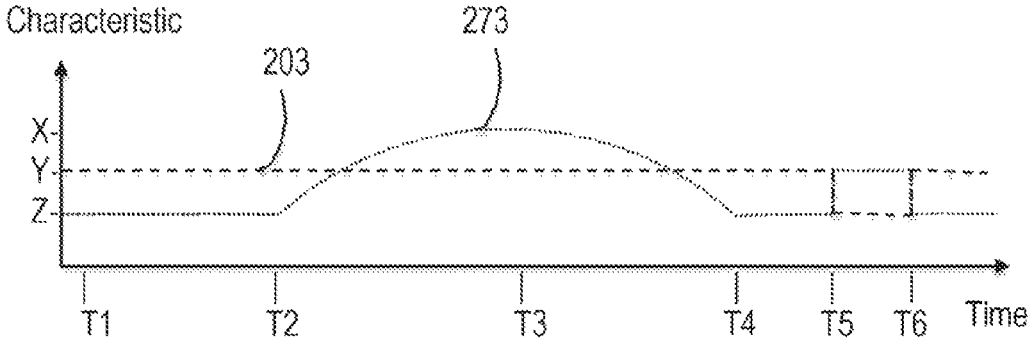
FIG. 3 is a graph showing illustrative characteristics of a process for manufacturing at least a portion of the cable structure of FIGS. 1-1B using the system of FIG. 2, in accordance with some embodiments of the invention.

As shown by graph 300 of FIG. 3, for example, the amount of a characteristic (e.g., mass) of base material 203 provided at times T1-T5 as well as after time T6 may be a constant amount Y and at a lower amount Z between times T5 and T6. Moreover, as also shown in FIG. 3, the amount of that same characteristic (e.g., mass) of foam material 273 provided between times T1 and T2, between times T4 and T5, as well as after time T6 may be a constant amount Z, at a gradually increasing amount between amounts Z and X between times T2 and T3, at a gradually decreasing amount between amounts X and Z between times T3 and T4, and at amount Y between times T5 and T6. In some embodiments, this combination of amounts of base material and foam material may combine to generate at least a portion of cover 104 of FIGS. 1-1B, where non-foam region 103 may be created between times T1 and T2, foam region 113 may be created between times T2 and T4, non-foam region 105 may be created between times T4 and T5, foam region 115 may be created between times T5 and T6, and non-foam region 107 may be created after time T6. The characteristic of graph 300 may be any suitable characteristic, such as mass, density, or any other suitable characteristic. It is to be understood that references to a "non-foam region" (e.g., non-foam region 105 of cover 104 of FIGS. 1 and 1B) may be any suitable region that may include no foam material or some foam material but less foam material than an adjacent foam region (e.g. non-foam region 105 may include some foam but less foam than adjacent foam region 113 or adjacent foam region 115). That is, amount Z of FIG. 3 may be some amount greater than zero (e.g., the amount of foam material 273 that may be emitted by foam metering device 272 may be at least a minimum amount such that foam metering device 272 does not have to be turned on and off during a manufacturing process of extruder system 200). Alternatively, in some embodiments, amount Z may be equal to zero amount of the characteristic.

Figure 4:
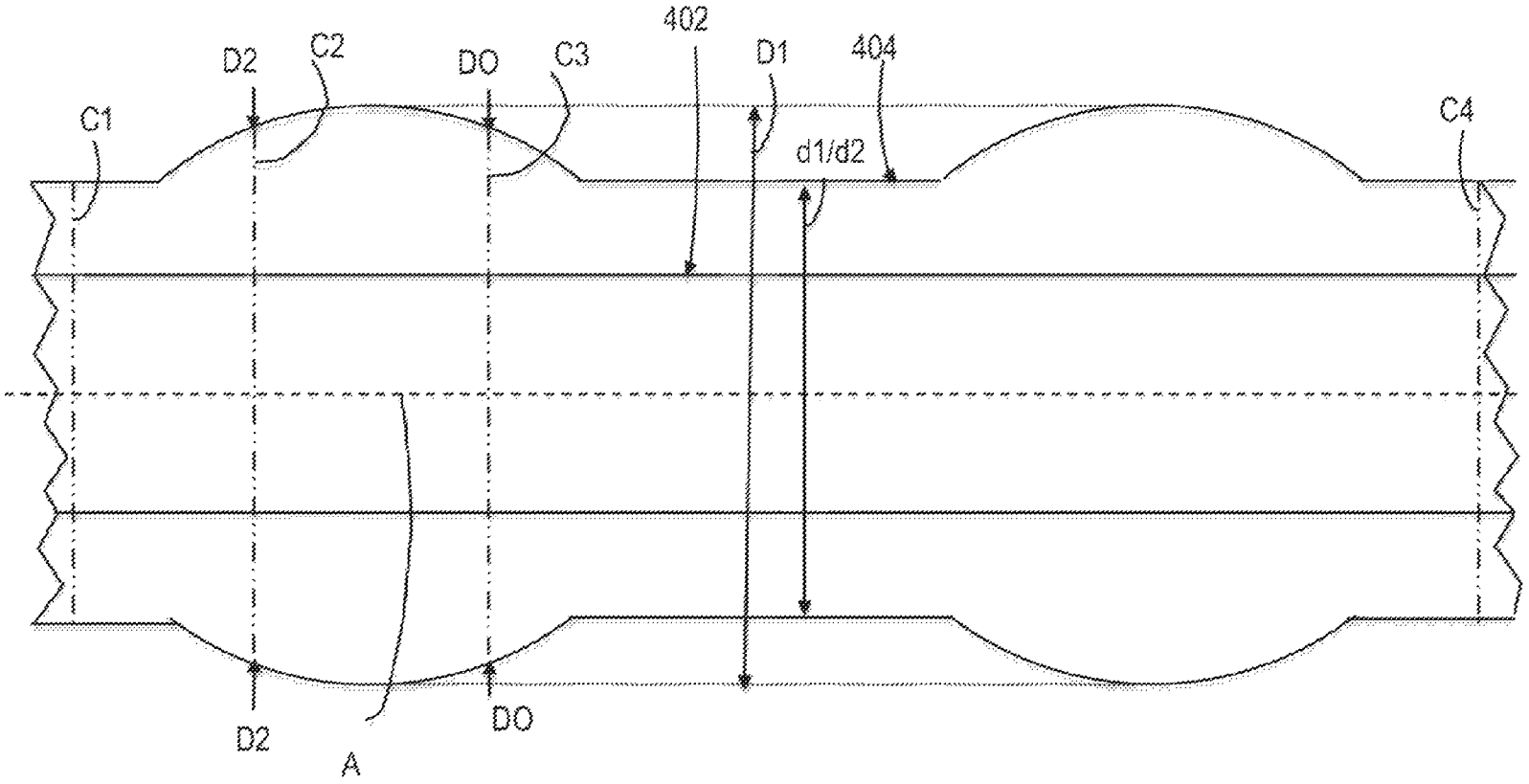
FIG. 4 is a cross-sectional view, similar to FIG. 1B, of a single structure that may be used to provide at least the cable structure of FIGS. 1-1B, in accordance with some embodiments of the invention.

Therefore, a manufacturing process of system 200 may enable creation of a cable structure that may include at least one foam region (e.g., at least one localized foam region adjacent a non-foam region). Such a foam region may be used as a strain relief for the cable structure, thereby obviating the need for any additional manufacturing processes that may add an additional strain relief component on top of or adjacent an end of the cable structure. Moreover, in some embodiments, a manufacturing process of system 200 may enable creation of multiple cable structures, at least one of which may include at least one foam region (e.g., at least one localized foam region adjacent a non-foam region). For example, a manufacturing process of system 200 may generate a single structure that may later be divided into multiple cable structures. As shown in FIG. 4, for example, at least a portion of a single structure 400 may be divided into multiple cable structures. Single structure 400 may be formed by a manufacturing process of system 200 similar to that described above with respect to FIG. 1B and FIG. 3, but repeated twice (e.g., structure 400 may be similar to the structure of FIG. 1B created twice consecutively during a single manufacturing process of system 200), where structure 400 may include a cover 404 about a conductor arrangement 402 along axis A. Then, one or more divisions may be made to structure 400 for creating multiple cable structures (e.g., multiple cable structures of assembly 100 of FIG. 1). For example, as shown in FIG. 4, cuts C1-C4 may be made through structure 400. Cut C1 may be made where structure 400 has a diameter d2, which may be equal to diameter d1, cut C2 may be made further along axis A where structure 400 has a diameter D2, which may be less than diameter D1, cut C3 may be made even further along axis A where structure 400 has a diameter D0, which may be less than diameter D1, and cut C4 may be made even further along axis A where structure 400 has a diameter d1, such that the resulting portion of structure 400 between cuts C1 and C2 may provide left cable structure 116 and such that the resulting portion of structure 400 between cuts C3 and C4 may provide main cable structure 112. Therefore, any number of cable structures may be realized by dividing up a single structure 400 that may have been created by a single manufacturing process of system 200.

Figure 5:
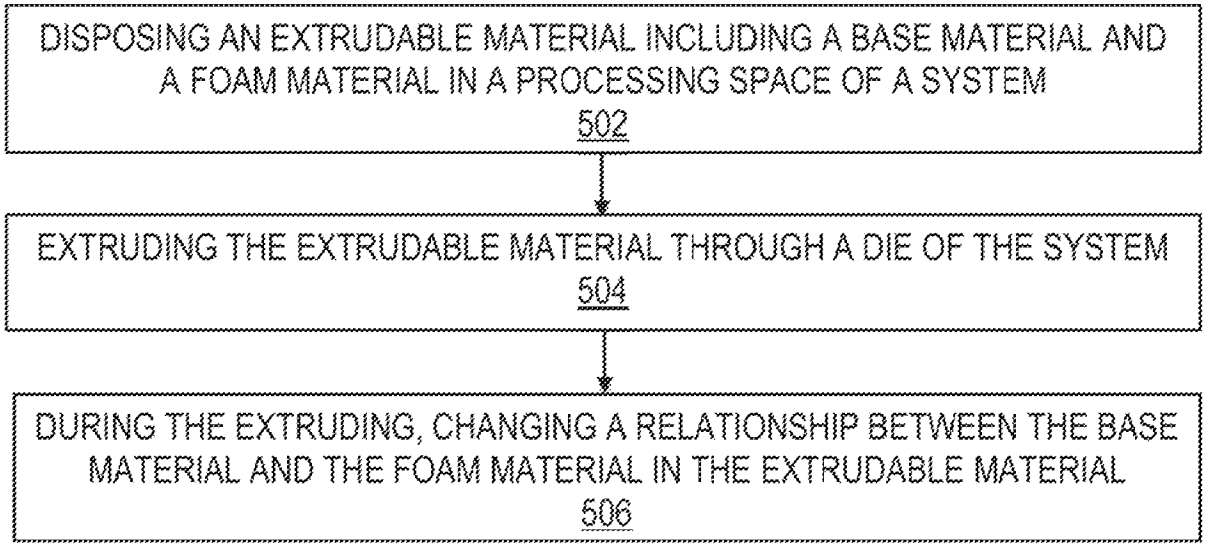
FIG. 5 is a flowchart of an illustrative process for manufacturing a cable structure, in accordance with various embodiments of the invention.

FIG. 5 is a flowchart of an illustrative process 500 for forming a cable structure. At step 502 of process 500, an extrudable material including a base material and a foam material may be disposed in a processing space of a system. For example, as described with respect to FIG. 2, a base material 203 and a foam material 273 may be disposed in any suitable processing space of system 200 (e.g., barrel cavity 221, feedpipe volume 241, die opening 254, and/or treatment volume 261) for further processing by system 200. Next, at step 504, the extrudable material may be extruded through a die of the system. For example, a solution of base material 203 and foam material 273 may be extruded through die 250 of system 200. During the extruding of step 504, process 500 may also include changing a relationship between the base material and the foam material in the extrudable material at step 506. For example, as described with respect to FIG. 3, one or both of the amount of a characteristic of foam material 273 and the amount of a characteristic of base material 203 provided in a certain portion of a cable structure cover may be varied over the length of the cover (e.g., may be varied amongst adjacent cross-sections of the cover along axis A, such as the cross-section of FIG. 1A that may be perpendicular to the extrusion process direction for the structure (e.g., the direction of arrow 211 of FIG. 2)), thereby changing a relationship between base material 203 and foam material 273 along the length of the cover.

It is understood that the steps shown in process 500 of FIG. 5 are merely illustrative and that existing steps may be modified or omitted, additional steps may be added, and the order of certain steps may be altered.

While there have been described cable structures with localized foam strain reliefs and systems and methods for making the same, it is to be understood that many changes may be made therein without departing from the spirit and scope of the invention. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. It is also to be understood that various directional and orientational terms, such as "up and "down," "front" and "back," "top" and "bottom" and "side," "length" and "width" and "thickness" and "diameter" and "cross-section" and "longitudinal," "X-" and "Y-" and "Z-," and the like may be used herein only for convenience, and that no fixed or absolute directional or orientational limitations are intended by the use of these words. For example, the cable structures of this invention can have any desired orientation. If reoriented, different directional or orientational terms may need to be used in their description, but that will not alter their fundamental nature as within the scope and spirit of this invention.

Therefore, those skilled in the art will appreciate that the invention can be practiced by other than the described embodiments, which are presented for purposes of illustration rather than of limitation.

What is claimed is:

1. A cable structure comprising:

a conductor arrangement extending along a length of the cable structure; and a cover surrounding the conductor arrangement along the length of the cable structure, wherein the cover comprises a single-phase solution, and wherein the density of the single-phase solution of the cover varies along the length of the cable structure.

2. The cable structure of claim 1, wherein the amount of foam in the single-phase solution of the cover varies along the length of the cable structure.

3. The cable structure of claim 1, wherein a ratio of base material to foam material within the single-phase solution of the cover varies along the length of the cable structure.

4. The cable structure of claim 1, wherein:

a first portion of the single-phase solution of the cover surrounding a first portion of the conductor arrangement along a first portion of the length of the cable structure comprises a first amount of foam;

a second portion of the single-phase solution of the cover surrounding a second portion of the conductor arrangement along a second portion of the length of the cable structure comprises a second amount of foam; and the first amount of foam is greater than the second amount of foam.

5. The cable structure of claim 4, wherein the diameter of the first portion of the single-phase solution of the cover is greater than the diameter of the second portion of the single-phase solution of the cover.

6. The cable structure of claim 4, wherein the diameter of the first portion of the single-phase solution of the cover is the same as the diameter of the second portion of the single-phase solution of the cover.

7. The cable structure of claim 4, wherein the first portion of the single-phase solution of the cover provides strain relief to the cable structure.

8. The cable structure of claim 4, wherein the first portion of the cable structure is at an end of the cable structure.

9. The cable structure of claim 1, wherein a portion of the cover provides at least a portion of the outer surface of the cable structure.

10. The cable structure of claim 1, wherein the entirety of the external surface of the cover is smooth.

11. A cable structure comprising:

a conductor arrangement extending along a longitudinal axis of a length of the cable structure; and a cover disposed about the conductor arrangement along the longitudinal axis, wherein:

at a first cross-section of the cable structure that is perpendicular to the longitudinal axis, the cover comprises a first amount of foam;

at a second cross-section of the cable structure that is perpendicular to the longitudinal axis, the cover comprises a second amount of foam that is less than the first amount of foam; and the outer diameter of the cover at the first cross-section is the same as the outer diameter of the cover at the second cross-section.

12. The cable structure of claim 11, wherein the cover at the first cross-section provides a strain relief to the cable structure.

13. The cable structure of claim 11, wherein a portion of the single-phase solution of the cover provides at least a portion of the outer surface of the cable structure.

14. The cable structure of claim 11, wherein the density of the cover at the first cross-section is different than the density of the cover at the second cross-section.

15. The cable structure of claim 11, wherein the cover comprises a single-phase solution, and wherein the density of the single-phase solution of the cover at the first cross-section is different than the density of the single-phase solution of the cover at the second cross-section.

16. The cable structure of claim 11, wherein a ratio of base material to foam material within the cover varies along the longitudinal axis.

17. The cable structure of claim 11, wherein the cover provides at least a portion of the outer surface of the cable structure.

18. The cable structure of claim 11, wherein the cover comprises a single-phase solution, and wherein a portion of the single-phase solution of the cover provides at least a portion of the outer surface of the cable structure.

19. The cable structure of claim 11, wherein the entirety of the external surface of the cover is smooth.

20. A cable structure comprising:

a conductor arrangement extending along a longitudinal axis of a length of the cable structure; and a cover disposed about the conductor arrangement along the longitudinal axis, wherein:

the cover comprises a single-phase solution;

at a first cross-section of the cable structure that is perpendicular to the longitudinal axis, the single-phase solution of the cover comprises a particular amount of foam; and at a second cross-section of the cable structure that is perpendicular to the longitudinal axis, the single-phase solution of the cover comprises less foam than the particular amount of foam.

21. A method for forming a cable structure, the method comprising: disposing an extrudable material in a processing space of a system, wherein the extrudable material comprises a base material and a foam material; extruding the extrudable material through a die of the system; and during the extruding, changing a relationship between the base material and the foam material in the extrudable material; wherein the changing varies a density of the cable structure and, wherein the changing does not vary an outer diameter of the cable structure.

22. The method of claim 21, wherein the changing creates a strain relief for the cable structure.

23. The method of claim 21, further comprising feeding a conductor arrangement through the die during the extruding, wherein the extruded material surrounds the conductor arrangement.

24. The method of claim 21, wherein the base material comprises a thermoplastic elastomer.

25. The method of claim 21, wherein the foam material comprises at least one of carbon dioxide and nitrogen.

26. The method of claim 21, further comprising treating a portion of the extruded material to change the density of the portion.

27. The method of claim 21, further comprising treating a portion of the extruded material, wherein the treating explodes at least some of the foam material of the extruded material of the portion.

* * * * *